US009827599B2

(12) United States Patent
Liang et al.

(10) Patent No.: US 9,827,599 B2
(45) Date of Patent: Nov. 28, 2017

(54) BANKNOTE RECOGNITION AND CLASSIFICATION METHOD AND SYSTEM

(71) Applicant: GRG Banking Equipment Co., Ltd., Guangzhou, Guangdong (CN)

(72) Inventors: Tiancai Liang, Guangzhou (CN); Panfeng Luo, Guangzhou (CN); Siwei Liu, Guangzhou (CN); Dingxi Chen, Guangzhou (CN); Weifeng Wang, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 5 days.

(21) Appl. No.: 14/889,425

(22) PCT Filed: Jan. 23, 2014

(86) PCT No.: PCT/CN2014/071202

§ 371 (c)(1),
(2) Date: Nov. 5, 2015

(87) PCT Pub. No.: WO2015/003486

PCT Pub. Date: Jan. 15, 2015

(65) Prior Publication Data

US 2016/0121370 A1 May 5, 2016

(30) Foreign Application Priority Data

Jul. 11, 2013 (CN) ..... 2013 1 0292056

(51) Int. Cl.
*B07C 5/344* (2006.01)
*G07D 7/12* (2016.01)
*G07D 7/187* (2016.01)

(52) U.S. Cl.
CPC ..... *B07C 5/344* (2013.01); *G07D 7/12* (2013.01); *G07D 7/187* (2013.01)

(58) Field of Classification Search
None
See application file for complete search history.

(56) References Cited

U.S. PATENT DOCUMENTS 4,435,834 A * 3/1984 Pauli ..... G07D 7/20 194/206
5,706,208 A * 1/1998 Osten ..... G01N 33/492 702/179

(Continued)

FOREIGN PATENT DOCUMENTS

CN 102034108 A 4/2011
CN 102110323 A 6/2011

(Continued)

OTHER PUBLICATIONS

Machine Translation of JP 2001022994 A.*

(Continued)

*Primary Examiner* — Michelle M Hausmann
(74) *Attorney, Agent, or Firm* — Wolf, Greenfield & Sacks, P.C.

(57) ABSTRACT

A banknote recognition and classification method and system are provided. In the method and system, a large number of reliable samples which are easy to acquire currently are used to establish a sample signal degradation model which meets application requirements by means of a statistical method, sample information is input into the banknote sample signal degeneration model to acquire various banknote sample information corresponding to the brand new banknotes to be learned; the various banknote sample information is input to perform classifier learning, and a banknote classification model is output; then a classifier learns to perform classification and recognition on a sample to be recognized.

6 Claims, 10 Drawing Sheets

(56) References Cited

U.S. PATENT DOCUMENTS

| | | | | | |
|---|---|---|---|---|---|
| 5,867,605 | A * | 2/1999 | Oliveras | H04N 19/80 | 375/E7.081 |
| 6,078,682 | A * | 6/2000 | Tanioka | G07D 7/12 | 355/133 |
| 6,370,216 | B1 * | 4/2002 | Lawandy | G07D 7/166 | 377/10 |
| 7,840,056 | B2 * | 11/2010 | Mukai | B65H 43/00 | 356/71 |
| 8,606,013 | B2 * | 12/2013 | Hamasaki | G06T 7/0004 | 382/135 |
| 2001/0014182 | A1 * | 8/2001 | Funayama | G06T 7/0081 | 382/282 |
| 2001/0035603 | A1 * | 11/2001 | Graves | G07D 7/166 | 271/265.01 |
| 2002/0092800 | A1 * | 7/2002 | Philipp | G07D 7/121 | 209/534 |
| 2003/0197866 | A1 | 10/2003 | Uemura et al. | | |
| 2004/0095374 | A1 * | 5/2004 | Jojic | G06T 7/2006 | 715/716 |
| 2004/0134981 | A1 * | 7/2004 | Voser | G07D 7/187 | 235/379 |
| 2005/0088550 | A1 * | 4/2005 | Mitsunaga | H04N 9/045 | 348/272 |
| 2007/0154078 | A1 * | 7/2007 | He | G07D 7/20 | 382/135 |
| 2007/0154099 | A1 | 7/2007 | He et al. | | |
| 2008/0189673 | A1 * | 8/2008 | Ying | G03F 1/36 | 716/52 |
| 2009/0324053 | A1 * | 12/2009 | Ross | G06K 9/2018 | 382/137 |
| 2010/0128986 | A1 * | 5/2010 | Xu | G06K 9/3208 | 382/190 |
| 2011/0229696 | A1 * | 9/2011 | Ratnukumar | G07D 7/122 | 428/172 |
| 2011/0267601 | A1 * | 11/2011 | Woodford | G07D 7/18 | 356/71 |
| 2012/0246048 | A1 * | 9/2012 | Cohen | G06Q 40/00 | 705/35 |
| 2013/0034291 | A1 * | 2/2013 | Minin | G06K 9/00 | 382/137 |
| 2014/0270460 | A1 | 9/2014 | Liang et al. | | |

FOREIGN PATENT DOCUMENTS

| | | | | | |
|---|---|---|---|---|---|
| CN | 102136166 | A | | 7/2011 | |
| CN | 102236897 | A | | 11/2011 | |
| CN | 102682514 | A | | 9/2012 | |
| CN | 102722708 | A | | 10/2012 | |
| CN | 103034840 | A | | 4/2013 | |
| CN | 103324946 | A | | 9/2013 | |
| EP | 2282299 | A2 | | 2/2011 | |
| EP | 2557523 | A1 | | 2/2013 | |
| JP | 2001022994 | A | * | 1/2001 | G07D 7/168 |
| RU | 2271576 | C2 | * | 3/2006 | |
| WO | WO 2007/068867 | A1 | | 6/2007 | |

OTHER PUBLICATIONS

Machine Translation of RU 2271576 C2.*

Jourdan, Thomas H., et al. "The quantitation of cocaine on US currency: survey and significance of the levels of contamination." Journal of forensic sciences 58.3 (2013): 616-624.*

He, Kexue, Shurong Peng, and Shutao Li. "A classification method for the dirty factor of banknotes based on neural network with sine basis functions." Intelligent Computation Technology and Automation (ICICTA), 2008 International Conference on. vol. 1. IEEE, 2008.*

Sato, Hisako, et al. "A new defect distribution metrology with a consistent discrete exponential formula and its applications." IEEE Transactions on Semiconductor Manufacturing 12.4 (1999): 409-418.*

International Search Report, dated Apr. 22, 2014, from corresponding International Application No. PCT/CN2014/071202.

Chinese Office Action, dated Oct. 27, 2015, from corresponding Chinese Patent Application No. 201310292056.4.

Ye: "Technological and Uses Thereof is Understood to the Paper Currency Image Analysis," 2010: The Chinese Doctoral Dissertation Full-Text Database Information Science and Technology pp. 1138-36.

Extended European Search Report, dated Jul. 11, 2016, from related European Application No. 14822674.9.

Notification on Grant of Patent Right for Invention, dated Jun. 26, 2016, from related Chinese Application No. 201310292056.4.

* cited by examiner

BANKNOTE RECOGNITION AND CLASSIFICATION METHOD AND SYSTEM

The present application claims the priority to Chinese Patent Application No. 201310292056.4, titled "BANKNOTE RECOGNITION AND CLASSIFICATION METHOD AND SYSTEM", filed on Jul. 11, 2013 with the State Intellectual Property Office of People's Republic of China, which is incorporated herein by reference in its entirety.

FIELD

The present application is the national phase of International Application No. PCT/CN2014/071202, titled "BANKNOTE RECOGNITION AND CLASSIFICATION METHOD AND SYSTEM", filed on Jan. 23, 2014, which claims the priority to Chinese Patent Application No. 201310292056.4, titled "BANKNOTE RECOGNITION AND CLASSIFICATION METHOD AND SYSTEM", filed on Jul. 11, 2013 with the State Intellectual Property Office of People's Republic of China, both of which are incorporated herein by reference.

BACKGROUND

At present, in banknote processing devices for the financial field such as cash circulator, banknote sorter, etc, a banknote recognition system has two main parts: a banknote classification learning system and a banknote recognition system, of which schematic structural diagrams are shown in FIG. 1 and FIG. 2. In the banknote classification learning system, banknote sample images to be learned are input, and a banknote classification model is output. In the banknote recognition system, a banknote sample image to be recognized is input, classification decision is performed on the sample through feature extraction and using the classification model acquired in the banknote classification learning system, and a final classification result is output.

For higher robustness of the banknote recognition system, i.e., to eliminate interference exerted by the quality of samples to be recognized on the recognition result as far as possible, abundant and diversified samples to be learned are normally input in the learning of the banknote classifier. When selecting samples, besides considering banknote samples in brand new condition, banknote samples in various conditions and banknote samples with contamination, incompletion, crack and folds in varying degrees need to be considered. Thus there is a large number of samples to be selected. Difficulty of the sample selection lies in the difficulty in collecting all types of banknotes in circulation, and particularly, for developing an algorithm with respect to foreign banknotes, it is almost impossible to collect a complete set of banknote samples. Generally speaking, the banknote samples to be learned mainly include the following types for selection: brand new condition, 80%-90% new condition, 70%-80% new condition, 0-70% new condition, contamination in varying degrees, incompletion in varying degrees, crack in varying degrees, and fold in a certain region, and if 30 banknotes are to be selected as samples for one type, 240 actually circulating banknotes satisfying the conditions are totally needed. If all needed types of banknotes may be completely collected to design a classifier, precision of the classifier may be ensured, and if the types of the samples are inadequate, it is possible that the precision of the classifier does not satisfy application requirement. However, to completely collect the various needed types of banknote samples in circulation, a large number of human resources and material resources may be needed, thereby affecting cost and efficiency for developing banknote recognition product; in other words, without extra cost spent to collect and screen the samples, the designed classifier may have decreased precision.

Hence, under the situation of limited number of selectable banknote samples, it is urgent for those skilled in the art to provide a method for recognizing and classifying banknotes and a system thereof to reduce extra cost while ensuring an improved classifier precision.

SUMMARY

In view of this, a method for recognizing and classifying banknotes and a system thereof are provided according to the disclosure to conquer a conventional problem that extra cost may not be reduced while ensuring classifier precision due to the case that adequate variety of needed samples can not be ensured when actual samples are collected.

To achieve the above purpose, the technical solutions provided according to the disclosure are as follows.

A method and for recognizing and classifying banknotes includes:

acquiring sample information of brand new banknotes to be learned and banknote sample information to be recognized;

establishing, according to a preset rule, a banknote sample signal degeneration model;

inputting the sample information into the banknote sample signal degeneration model to acquire various banknote sample information corresponding to the brand new banknotes to be learned;

inputting the various banknote sample information to perform classifier learning, and outputting a banknote classification model; and performing sample signal preprocessing and feature extraction on the sample information to be recognized, performing classification decision on the banknote to be recognized by using the classification model, and outputting a final classification result.

The banknote sample signal degeneration model includes: a banknote condition degeneration model established based on linear change of image brightness and a banknote image degeneration model established based on randomness of a statistic model.

The banknote image degeneration model includes signal degeneration models for banknote contamination, banknote incompletion, banknote crack, and banknote fold or deflection, and the banknote condition degeneration model includes degeneration models for banknotes in brand new condition, banknotes in 80%-90% new condition, banknotes in 70%-80% new condition, and banknotes in 0-70% new condition.

The establishing a banknote condition degeneration model according to a preset rule includes:

analyzing a gray distribution $f(x)=ax+b$ of an image for a banknote of a specific denomination of a specific currency, and dividing, according to gray similarity, the banknote of the specific denomination of the currency into five regions;

selecting a set of samples in brand new condition, and performing statistics on average gray value G for each banknote in the sample set;

selecting a set of samples in one of the conditions, and performing statistics on average gray value g for respective regions of each sample;

matching the average gray values G to the average gray values g respectively;

combining every two of the formulas $f(x)=ax+b$ for the five regions to calculate a and b for each formula; and selecting a set of samples in brand new condition, and calculating average gray value for each region of all banknote images, where each average gray value corresponds to a mapping to the gray distribution $f(x)=ax+b$.

The establishing a banknote contamination degeneration model according to a preset rule includes:

presetting that a banknote contamination region is circular and a stain is circular, and each banknote only have one contamination region; and determining, according to statistics analysis, that probability density curves for a position of the contamination region and a position of the stain in the contamination region are constants, i.e., the probability density curves are in uniform distribution $X \sim U(a,b)$ and probability density curve for a size of the contamination region and probability density curves for size, density and gray value of the stain are in normal distribution $X \sim N(\mu,\sigma^2)$.

The establishing a banknote incompletion degeneration model according to a preset rule includes:

determining, according to statistics analysis, a position, a size and a shape of an incompletion, where a probability density curve of the position of the incompletion is a constant;

a probability density curve of the size of the incompletion is in normal distribution; and the shape of the incompletion is polygon which is any one of trigon to octagon, convex polygon or concave polygon, and a probability density curve of the shape of the incompletion is a constant.

The establishing a banknote folding or deflection degeneration model includes:

dividing the banknote into two columns and two rows to form four uniform rectangular regions each having a long side and a short side which belong to edges of the banknote;

randomly selecting one of the regions, randomly selecting one point of the short side of the region, and randomly selecting another point of the long side of the region;

determining whether a distance between the two points, i.e., the distances x (a distance on the long side) and y (a distance on the short side) from the two points to the vertex, satisfy a constraint condition of $\sqrt{x^2+y^2}<k$, $x<m$, $y<n$, if the distance between the two points satisfies the constraint condition, proceeding to a next step, and if the distance between the points does not satisfy the constraint condition, returning to the previous step; and filing a deflection region, which has an edge being a straight line determined by the two points and has a point beyond the edge, with background color.

The establishing a banknote crack degeneration model according to a preset rule includes:

randomly acquiring a line segment s with a length of L on the boundary of the banknote, where L is in uniform distribution, $L \in (0,MaxL)$, and MaxL is a maximum length of the boundary of the banknote;

determining a position of another point N, where a distance between the point N and a midpoint M of the line segment s is 1, and an angle between the line segment MN and the line segment s is, where $l \in (0,Maxl)$, the angle $\alpha \in (\pi/3,2\pi/3)$, and $\alpha$ and l are in normal distribution; and determining a triangle region bounded by the point N and the segment line s as the crack region, and filling the crack region with the background color.

A system for recognizing and classifying banknotes is disclosed according to the disclosure. The system includes:

an acquiring unit configured to acquire sample information of brand new banknotes to be learned and banknote sample information to be recognized;

a model establishing unit configured to establish a banknote sample signal degeneration model according to a preset rule;

an inputting unit configured to input the sample information into the banknote sample signal degeneration model to acquire various banknote sample information corresponding to the brand new banknotes to be learned;

a classifier learning unit configured to input the various banknote sample information to perform classifier learning, and output a banknote classification model; and a classification result outputting unit configured to perform sample signal preprocessing and feature extraction on the sample information to be recognized, perform classification decision on the banknote to be recognized by using the classification model, and output a final classification result.

It can be known from above technical solutions that compared with conventional technology, a method for recognizing and classifying banknotes and a system thereof are disclosed according to the disclosure, and the method includes: acquiring sample information of brand new banknotes to be learned and banknote sample information to be recognized; establishing, according to a preset rule, a banknote sample signal degeneration model; inputting the sample information into the banknote sample signal degeneration model to acquire various banknote sample information corresponding to the brand new banknotes to be learned; inputting the various banknote sample information to perform classifier learning, and outputting a banknote classification model; performing sample signal preprocessing and feature extraction on the sample information to be recognized, performing classification decision on the banknote to be recognized by using the classification model, and outputting a final classification result. In the method, large amount of existing samples which are reliable and easily accessible are used to statistically establish a sample signal degeneration model which satisfies application requirement, to simulate the states of banknotes such as brand new condition, 80%-90% new condition, 70%-80% new condition, 0-70% new condition, contamination in varying degrees, incompletion in varying degrees, crack in varying degrees and folds in some regions, then classifier learning is performed, and classification recognition is performed on the sample to be recognized, thereby accurately acquiring a classification result, and decreasing cost and efficiency for developing banknote recognition product while ensuring improvement of classifier precision.

BRIEF DESCRIPTION OF THE DRAWINGS

To illustrate the technical solutions according to the embodiments of the present disclosure or technical solutions in conventional technology more clearly, the drawings involved in the embodiments of the present disclosure or in the conventional technology are introduced briefly in the following. Apparently, the drawings described below are only embodiments of the disclosure, and persons of ordinary skills in the art can derive other drawings according to the drawings without any creative effort.

DETAILED DESCRIPTION

Technical solutions of the embodiments of the present disclosure are illustrated completely and clearly with the following drawings of the embodiments of the disclosure. Apparently, the described embodiments are merely a few rather than all of the embodiments of the present disclosure. All other embodiments obtained by persons of ordinary skill in the art based on the embodiments of the present disclosure without creative efforts shall fall within the protection scope of the present disclosure.

A method for recognizing and classifying banknotes and a system thereof are disclosed according to the disclosure. The method includes: acquiring sample information of brand new banknotes to be learned and banknote sample information to be recognized; establishing, according to a preset rule, a banknote sample signal degeneration model; inputting the sample information into the banknote sample signal degeneration model to acquire various banknote sample information corresponding to the brand new banknote to be learned; inputting the various banknote sample information to perform classifier learning, and outputting a banknote classification model; performing sample signal preprocessing and feature extraction on the sample information to be recognized, performing classification decision on the banknote to be recognized by using the classification model, and outputting a final classification result. In the method, large amount of existing samples which are reliable and easily accessible are used to statistically establish a sample signal degeneration model which satisfies application requirement, to simulate the states of banknotes such as brand new condition, 80%-90% new condition, 70%-80% new condition, 0-70% new condition, contamination in varying degrees, incompletion in varying degrees, crack in varying degrees and folds in some regions, then classifier learning is performed, and classification recognition is performed on the sample to be recognized, thereby accurately acquiring a classification result, and decreasing cost and efficiency for developing banknote recognition product while ensuring improvement of classifier precision.

Figure 1:
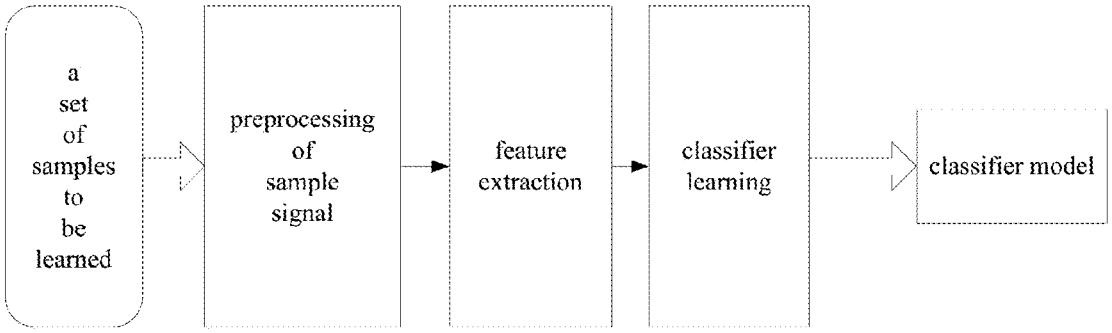
FIG. 1 is a schematic structural diagram of a banknote classification learning system in conventional technology.
Figure 2:
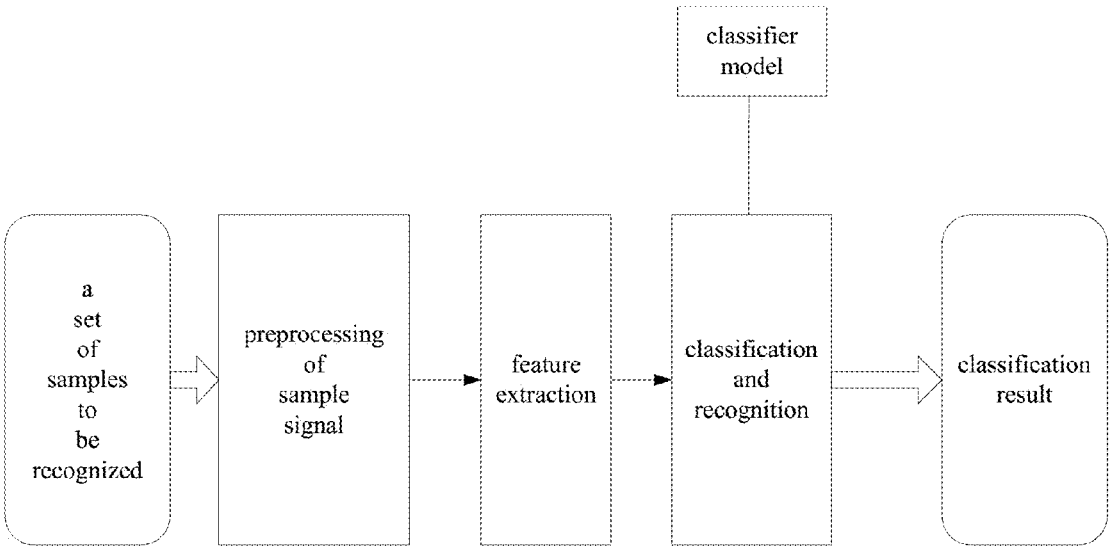
FIG. 2 is a schematic structural diagram of a banknote recognition system in conventional technology.
Figure 3:
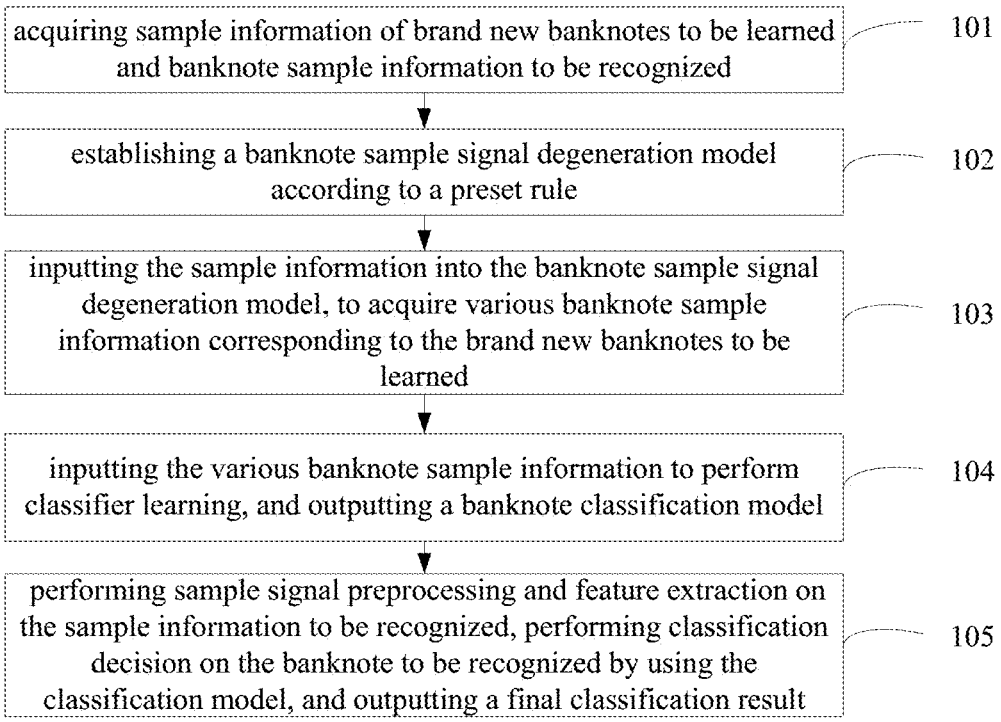
FIG. 3 is a flow chart of a method for recognizing and classifying banknotes disclosed according to an embodiment of the disclosure.

FIG. 3 is a flow chart of a method for recognizing and classifying banknotes disclosed according to the disclosure. A method for recognizing and classifying banknotes is disclosed according to the disclosure. The method includes following steps.

Step 101 includes: acquiring sample information of brand new banknotes to be learned and banknote sample information to be recognized.

For higher robustness of the recognition system, abundant and diversified samples need to be input to design a classifier. However, in the field of circulation, in particular to design an algorithm for recognizing foreign banknotes, it is almost impossible to completely collect all needed types of banknote samples to be learned. Hence, in this solution, since brand new banknote samples are easily accessible, it is designed to acquire the sample information of brand new banknotes to be learned. According to these brand new banknotes, various banknotes are simulated. Generally speaking, banknote samples to be learned may be roughly selected from following types: brand new condition, 80%-90% new condition, 70%-80% new condition, 0-70% new condition, contamination in varying degrees, incompletion in varying degrees, crack in varying degrees, and fold in a certain region.

Step 102 includes: establishing a banknote sample signal degeneration model according to a preset rule.

Based on the acquired sample information of brand new banknotes to be learned, the banknote sample signal degeneration model is established according to the preset rule. The establishment of the degeneration model includes establishing a banknote condition degeneration model based on linear change of image brightness, and establishing a banknote image degeneration model based on randomness of a statistic model.

The banknote image degeneration model includes signal degeneration models for banknote contamination, banknote incompletion, banknote crack, and banknote fold or deflection, and the banknote condition degeneration model includes degeneration models for banknotes in brand new condition, banknotes in 80%-90% new condition, banknotes in 70%-80% new condition, and banknotes in 0-70% new condition.

Step 103 includes: inputting the sample information into the banknote sample signal degeneration model, to acquire various banknote sample information corresponding to the brand new banknotes to be learned.

Step 104 includes inputting the various banknote sample information to perform classifier learning, and outputting a banknote classification model.

Step 105 includes: performing sample signal preprocessing and feature extraction on the sample information to be recognized, performing classification decision on the banknote to be recognized by using the classification model, and outputting a final classification result.

After a banknote is used for a period, due to characteristics of paper, paper fiber suffers a certain degree of wear or a certain accumulation of dirt, thus the banknote image has a decreased overall gray value. Through statistical analysis, gray value for each pixel point of the image changes linearly, i.e., $y=f(x)$, theoretically $f(x)$ may be fitted through a certain amount of sample data, but the form of $f(x)$ is hard to be determined, and through lots of sample experiments, an intuitive method adaptive to engineering implementation is provided.

A sample set with abundant and diversified banknotes is used to establish parameters for a condition degeneration model. It is assumed that $f(x)=ax+b$. However, the mapping may not be applicable to each point in the banknote image. Through analysis, in a region with originally high gray value, change in gray value is relatively more significant, and in a region with originally low gray value, change in gray value is relatively less significant, that is, $f(x)$ is different in different gray regions.

Figure 4:
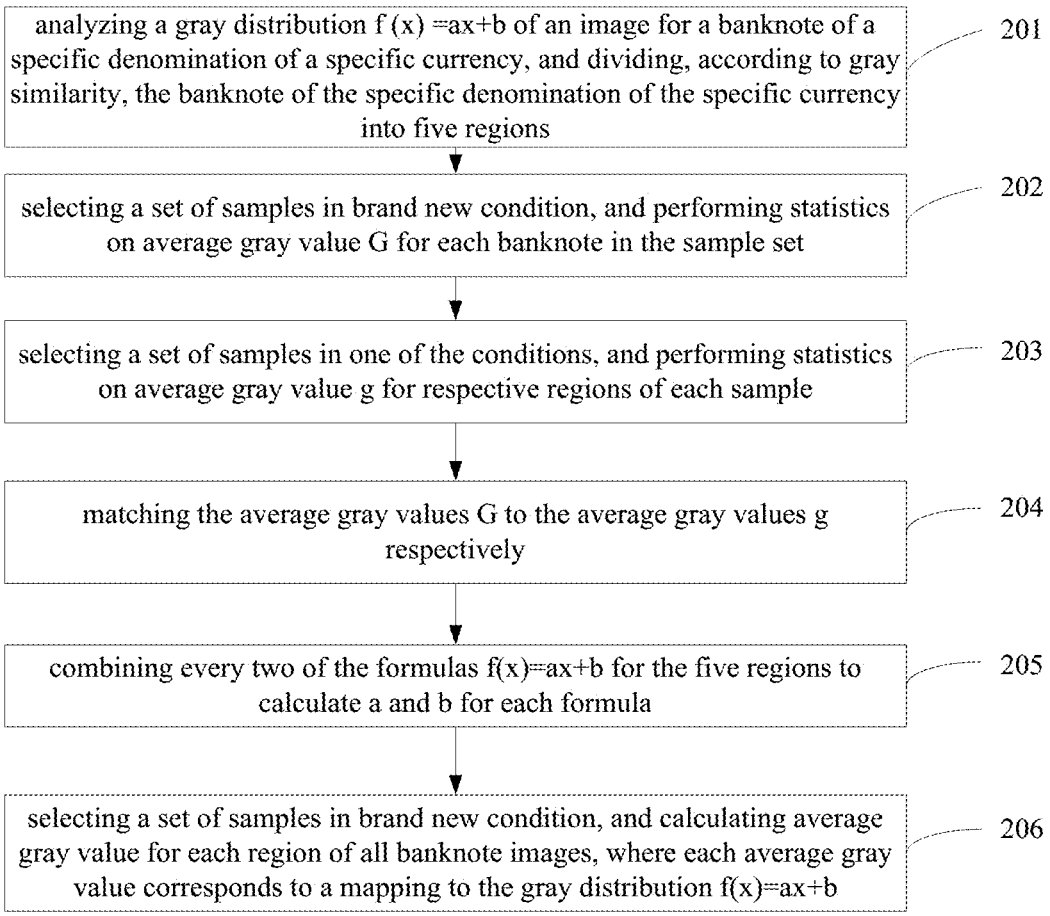
FIG. 4 is a flow chart of establishing a banknote condition degeneration model according to a preset rule.

FIG. 4 is a flow chart of establishing a banknote condition degeneration model according to a preset rule. The establishing a banknote condition degeneration model according to a preset rule includes following steps.

Step 201: analyzing a gray distribution $f(x)=ax+b$ of an image for a banknote of a specific denomination of a specific currency, and dividing, according to gray similarity, the banknote of the specific denomination of the specific currency into five regions.

Figure 5:
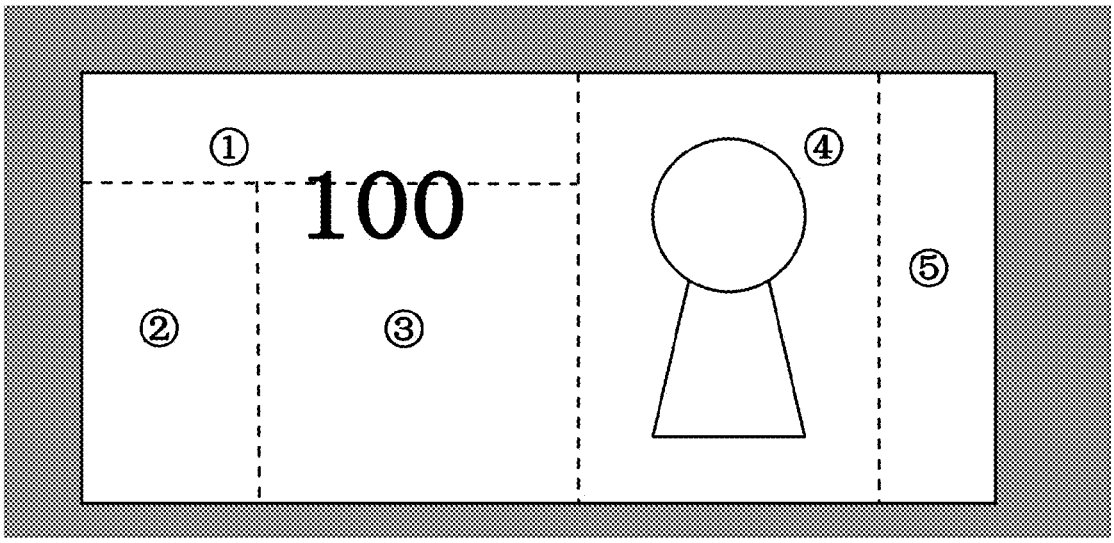
FIG. 5 is a diagram for gray scale-based region division in a banknote condition degeneration model.

As shown in FIG. 5, the five regions correspond to $f_1(x)=a_1x+b_1$, $f_2(x)=a_2x+b_2$, $f_3(x)=a_3x+b_3$, $f_4(x)=a_4x+b_4$ and $f_5(x)=a_5x+b_5$ respectively.

Step 202: selecting a set of samples in brand new condition, and performing statistics on average gray value G for each banknote in the sample set, i.e., $G_{1i}$, $G_{2i}$, $G_{3i}$, $G_{4i}$ and $G_{5i}$, where i=1, 2, 3, . . . , n, and the sample set has n samples.

Step 203: selecting a set of samples in one of the conditions, and performing statistics on average gray value g for respective regions of each sample.

For example, taking banknotes in 80%-90% new condition as an example, statistics is performed on average gray values $g_{11i}$, $g_{12i}$, $g_{13i}$, $g_{14i}$, and $g_{15i}$ for regions of respective samples, where i=1, 2, 3, . . . , n, and the sample set has n samples.

Step 204: matching the average gray values G to the average gray values g respectively.

(1) $f_1(x)$ in region 1 is fitted, the average gray values acquired in step 2 and step 3 are respectively matched, $\{G_{1i}, g_{11i}\}$, where i=1, 2, 3, . . . , n, and there are total n groups of data.

(2) At least two groups of data are needed to calculate $a_1$ and $b_1$, every two groups of data which are acquired in step (1) are combined, and respective values of $a_{1m}$ and $b_{1m}$ are calculated, i.e., $\{G_{11}, g_{111}\}$ and $\{G_{12}, g_{112}\}$ are combined to acquire $\{a_{11}, b_{11}\}$, $\{G_{11}, g_{111}\}$ and $\{G_{12}, g_{112}\}$ are combined to acquire $\{a_{12}, b_{12}\}$, by that analogy, $\{a_{11}, b_{11}\}$, $\{a_{12}, b_{12}\}$, . . . $\{a_{1m}, b_{1m}\}$ are acquired, where m=n/2.

(3) A data distribution of the set of $\{a_{1m}, b_{1m}\}$ is analyzed, abnormal data is removed, a median of data in the set (or an average value, or a value determined by another rule) is used as $(a_1, b_1)$.

(4) Similarly, steps (1)-(3) are repeated, thus values in other regions, i.e., $(a_2, b_2)$, $(a_3, b_3)$, $(a_4, b_4)$ and $(a_5, b_5)$ are calculated.

Step 205: combining every two of the formulas $f(x)=ax+b$ for the five regions to calculate a and b for each formula.

Step 206: selecting a set of samples in brand new condition, and calculating average gray value for each region of all banknote images, where each average gray value corresponds to a mapping to the gray distribution $f(x)=ax+b$.

That is, the average gray values are $G_1$, $G_2$, $G_3$, $G_4$ and $G_5$, of which mappings are $G_1-f_1(x)$, $G_2-f_2(x)$, $G_3-f_3(x)$, $G_4-f_4(x)$ and $G_5-f_5(x)$.

According to the established banknote condition degeneration model, through statistics and fitting for a large number of data, for banknote images with similar textures, 0-255 gray levels may be divided into 16 gray segments each corresponding to a degeneration mapping, i.e., (0x00-0x0F)$-f_1(x)$, (0x10-0x1F)$-f_2(x)$, (0x20-0x2F)$-f_3(x)$, (0x30-0x3F)$-f_4(x)$ (0x40-0x4F)$-f_5(x)$, (0x50-0x5F)$-f_6(x)$, (0x60-0x6F)$-f_7(x)$, (0x70-0x7F)$-f_8(x)$, (0x80-0x8F)$-f_9(x)$, (0x90-0x9F)$-f_{10}(x)$, (0xA0-0xAF)$-f_{11}(x)$, (0xB0-0xBF)$-f_{12}(x)$, (0xC0-0xCF)$-f_{13}(x)$, (0xD0-0xDF)$-f_{14}(x)$, (0xE0-0xEF)$-f_{15}(x)$ and (0xF0-0xFF)$-f_{16}(x)$.

After the banknote condition degeneration model is established, steps of simulating condition of banknote images with insufficient samples are as follows. It is assumed that the banknote image to be processed is in brand new condition.

A first step includes: dividing, according to a gray distribution of a banknote image, the image into a plurality of regions, and calculating average gray value for each region.

Figure 6:
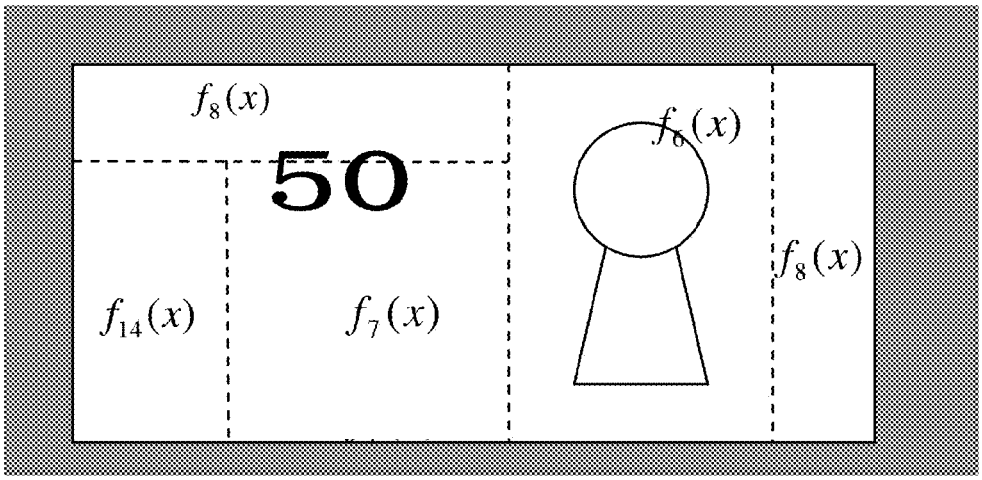
FIG. 6 is a diagram for gray scale-based region division for an image on which degeneration is to be simulated.

A second step includes: determining a corresponding degeneration function according to the average gray value for each region acquired in the first step. For example, as shown in FIG. 6, for the image on which the degeneration is to be simulated, the five divided regions correspond to five mappings $f_8(x)$,$f_{14}(x)$ $f_7(x)$, $f_6(x)$ and $f_8(x)$ respectively.

A third step includes: performing corresponding degeneration mappings on gray vales for respective pixel points in each region in turn to acquire gray values for the respective pixel points after degeneration until all pixel points of the image are mapped.

Contamination, incompletion, crack and fold may be seen as special image noise for establishing relevant models, which are different from traditional noise; the noise generated from the traditional noise model is in the form of singular random points, and the noise generated from the noise model proposed in these embodiments is in the form of points in a random region, which have a special feature as well as a certain randomness.

Figure 7:
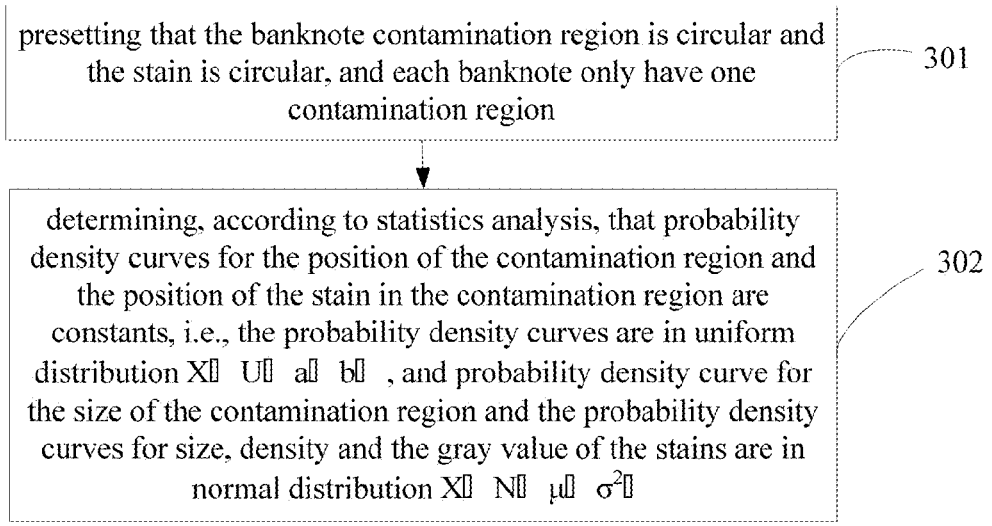
FIG. 7 is a flow chart for establishing a banknote contamination degeneration model according to a preset rule.

FIG. 7 is a flow chart for establishing a banknote contamination degeneration model according to a preset rule. The establishing a banknote contamination degeneration model according to a preset rule includes following steps.

The contamination noise mainly has features of shape, size and position of a contamination region, density of stains in the region, and shape, size and gray value for each stain.

Step 301 includes: presetting that the banknote contamination region is circular and the stain is circular, and each banknote only have one contamination region.

Step 302 includes: determining, according to statistics analysis, that probability density curves for the position of the contamination region and a position of the stain in the contamination region are constants, i.e., the probability density curves are in uniform distribution $X\sim U(a,b)$, and a probability density curve for a size of the contamination region and probability density curves for size, density and gray value of the stain are in normal distribution $X\sim N(\mu,\sigma^2)$.

The probability density curve for the position of the contamination region is a constant, i.e., the contamination region may appear, with equal probability, at any position of the banknote.

Through statistics analysis on the size of the contamination region and the density of the stains in the region, the size (radius) of the contamination region is in normal distribution with an average value of $\mu_{11}$ and a variance of $\sigma_{11}$, the density of the stains is irrelevant to the size of the contamination region, and the probability density of the stains satisfies an independent normal distribution with an average value of $\mu_{12}$ and a variance of $\sigma_{12}$.

The probability density curve of the position of the stain in the region is a constant, i.e., the stain appears, with equal probability, at any position of the region.

Probability density curves for the size of the stain and the gray value of the stain are in independent normal distribution respectively; the size of the stain has an average value of $\mu_{13}$ and a variances of $\sigma_{13}$, the gray value of the stain has an average value of $\mu_{14}$ and a variance of $\sigma_{14}$.

Figure 8:
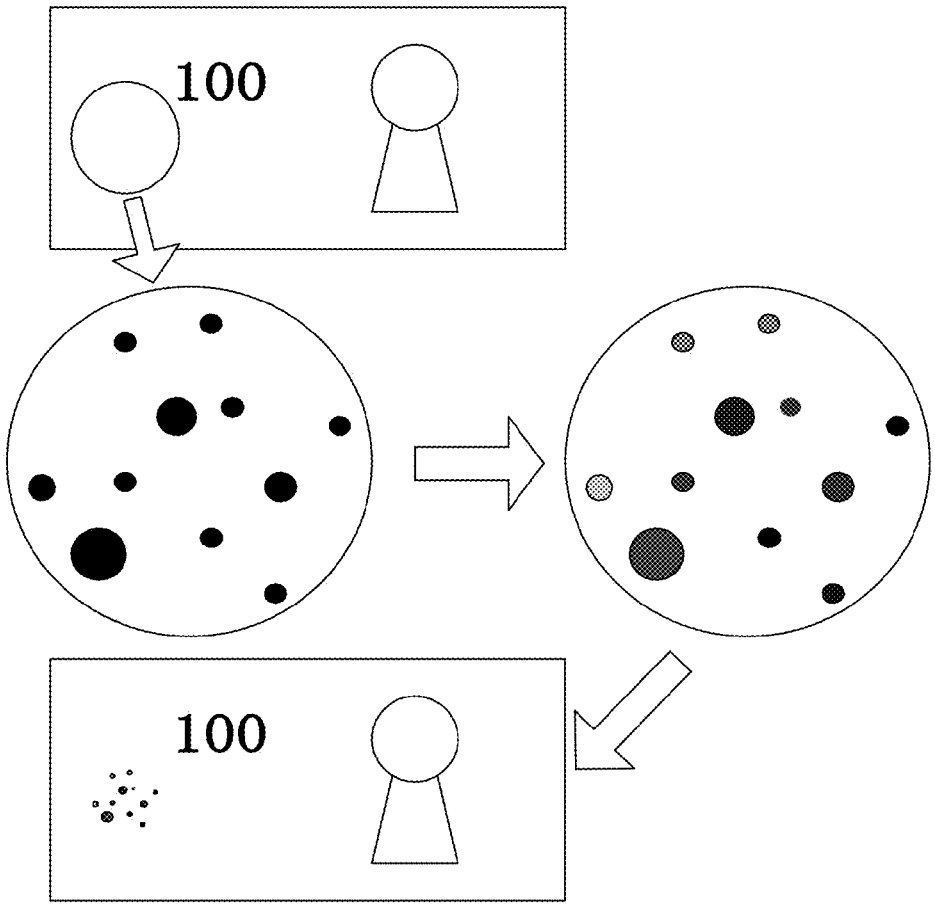
FIG. 8 is a schematic diagram showing steps of banknote image degeneration based on a contamination noise model.

FIG. 8 is a schematic diagram showing steps of banknote image degeneration based on a contamination noise model.

A first step includes: randomly generating a special position in a banknote region according to a probability density curve of a position of a contamination region.

A second step includes: randomly generating, according to a probability density curve of a size of the contamination region, a radius value, and determining the contamination region and the size thereof by using the position of the point generated in the first step as a center of a circle.

A third step includes: randomly generating a density value according to a probability density function of density of stains in the contamination region, and determining a quantity of the stains in the region.

A fourth step includes: determining position, size and gray value for each stain in the region, marking each stain in the region sequentially, and randomly determining corresponding values according to probability density curves respectively.

The fourth step includes following sub-steps:

(1) randomly generating coordinate values for a stain in the region according to the probability density curve of the position of the stain in the region;

(2) randomly generating a radius of the stain according to the probability density curve of the size of the stain, and determining the position and the size of the stain by using the coordinate point in step (1) as the center of the stain;

(3) randomly generating the gray value of the stain according to the probability density curve of the gray value of the stain; and (4) determining whether the stain is the last point in the contamination region; if the stain is the last point in the contamination region, proceeding to a fifth step; and if the stain is not the last point in the contamination region, returning to step (1) and continually generating a stain.

The fifth step includes fusing the generated noise with the original image.

Figure 9:
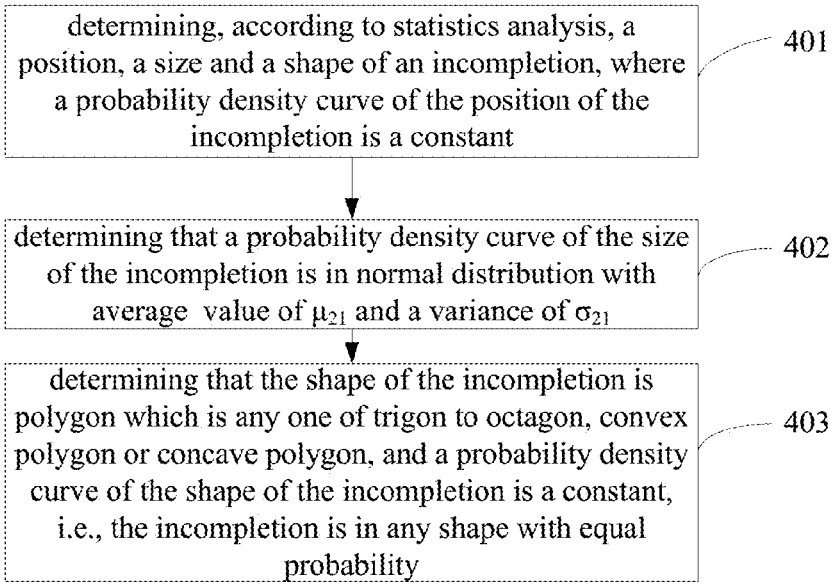
FIG. 9 is a flow chart of establishing a banknote incompletion degeneration model according to a preset rule.

FIG. 9 is a flow chart of establishing a banknote incompletion degeneration model according to a preset rule. The establishing a banknote incompletion degeneration model according to a preset rule includes following steps.

Step 401 includes: determining, according to statistics analysis, a position, a size and a shape of an incompletion, where a probability density curve of the position of the incompletion is a constant, i.e., the incompletion appears, with equal probability, at any position of the banknote.

Step 402 includes: determining that a probability density curve of the size of the incompletion is in normal distribution with an average value of $\mu_{21}$, and a variance of $\sigma_{21}$.

Step 403 includes: determining that the shape of the incompletion is polygon which is any one of trigon to octagon, convex polygon or concave polygon, and a probability density curve of the shape of the incompletion is a constant, i.e., the incompletion is in any shape with equal probability.

Figure 10:
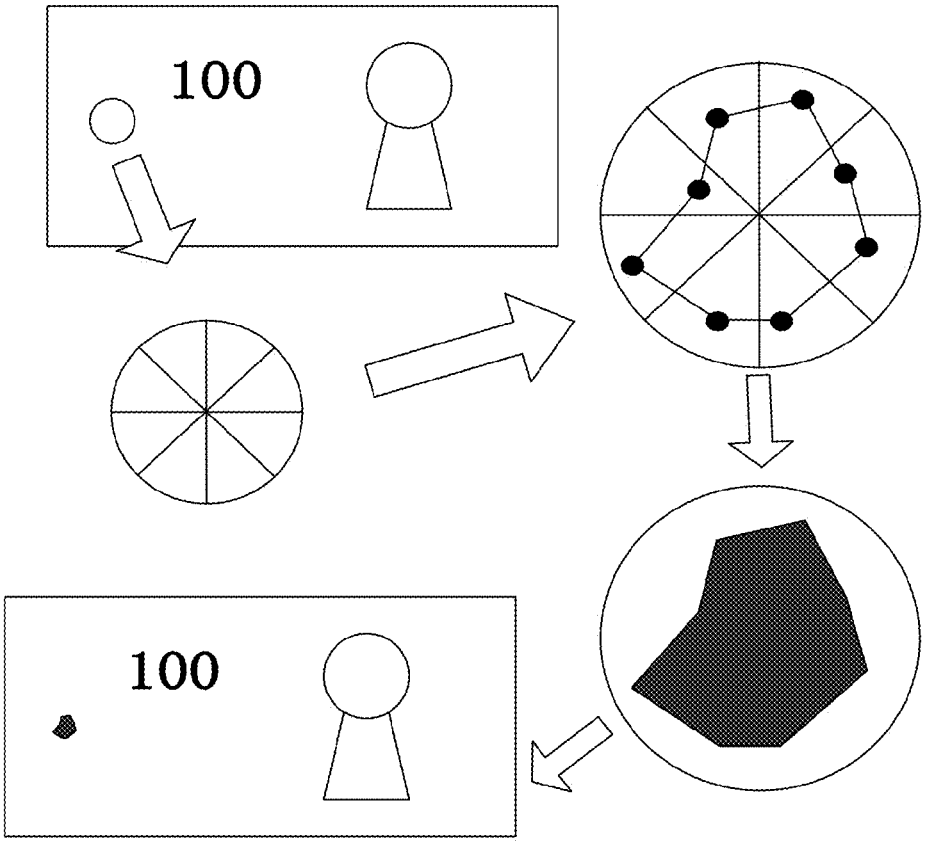
FIG. 10 is a schematic diagram showing steps of banknote image degeneration based on an incompletion noise model.

FIG. 10 is a schematic diagram showing steps of banknote image degeneration based on an incompletion noise model.

A first step includes: randomly determining a special position in the banknote region according to the probability density curve of a position of an incompletion region.

A second step includes: randomly generating a radius of the incompletion region according to the probability density curve of a size of the incompletion, and using the coordinates of the position acquired in the first step as a circle center of the region.

A third step includes: determining a shape of the incompletion region. Specially, the third step are implemented as following steps:

(1) determining a circle region with the circle center generated in the first step and the radius generated in the second step;

(2) randomly generating n, where the incompletion is a polygon with n edges, and n is in uniform distribution, where $n \in [3,8], n \in Z$;

(3) evenly dividing the circle region acquired in step (1) into n fan regions by using the circle center as a center;

(4) acquiring one random point from each fan region, where the point locates, with equal probability, at any position of the fan region; and (5) jointing, through straight lines, the n points to form a closed polygon.

A fourth step includes: filling the region within the closed polygon with background color (black) and using the region as a banknote incompletion.

Figure 11:
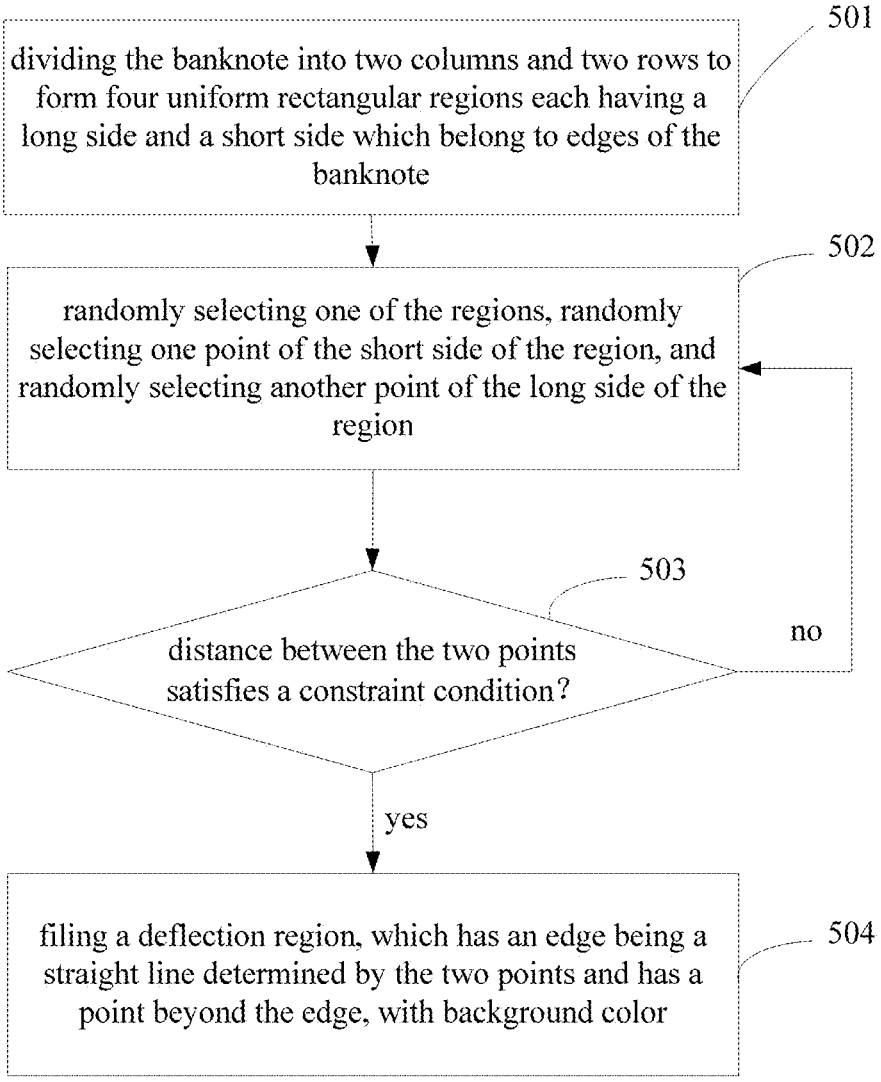
FIG. 11 is a flow chart of establishing a banknote folding or deflection degeneration model based on a preset rule.

FIG. 11 is a flow chart of establishing a banknote folding or deflection degeneration model based on a preset rule. The establishing a banknote folding or deflection degeneration model includes following steps.

The banknote is normally deflected at the edge portion, and the deflected portion of the banknote is generally small. According to this character, the folding (deflection) noise model may be established according to following steps.

Step 501 includes: dividing the banknote into two columns and two rows to form four uniform rectangular regions each having a long side and a short side which belong to edges of the banknote.

Step 502 includes: randomly selecting one of the regions, randomly selecting one point of the short side of the region, and randomly selecting another point of the long side of the region.

Step 503 includes: determining whether a distance between the two points. i.e., the distances x (a distance on the long side) and y (a distance on the short side) from the two points to the vertex, satisfy a constraint condition of $\sqrt{x^2+y^2}<k$, $x<m$, $y<n$; if the distance between the two points satisfies the constraint condition, proceeding to a next step; and if the distance between the points does not satisfy the constraint condition, returning to the previous step.

Step 504 includes: filing a deflection region, which has an edge being a straight line determined by the two points and has a point beyond the edge, with background color.

Figure 12:
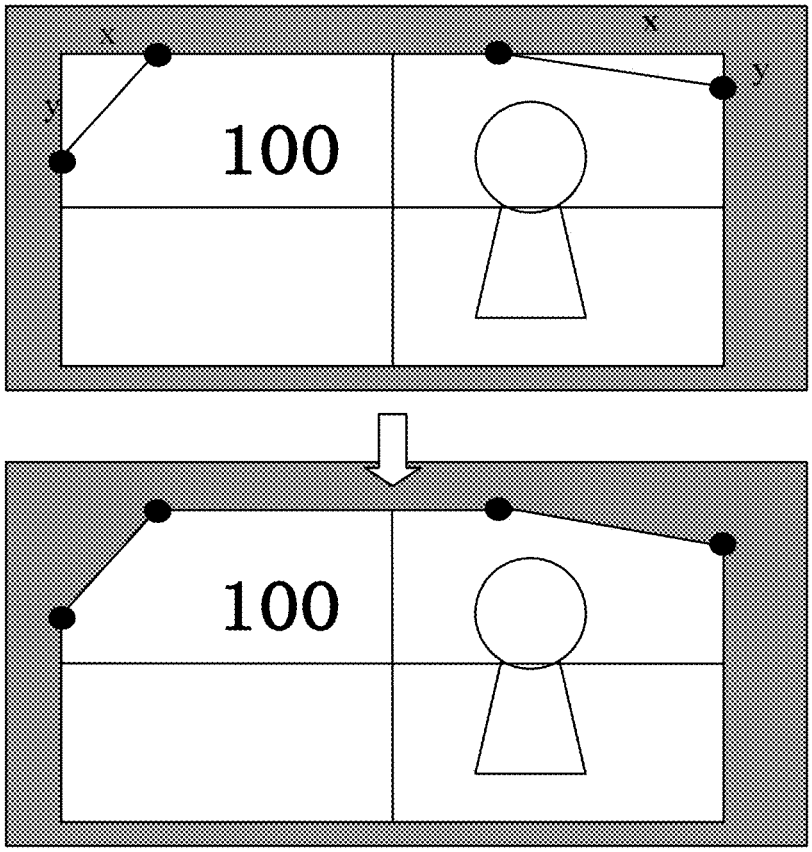
FIG. 12 is a schematic diagram showing steps of banknote image degeneration based on a folding or deflection noise model.

FIG. 12 is a schematic diagram showing steps of banknote image degeneration based on a folding or deflection noise model.

Figure 13:
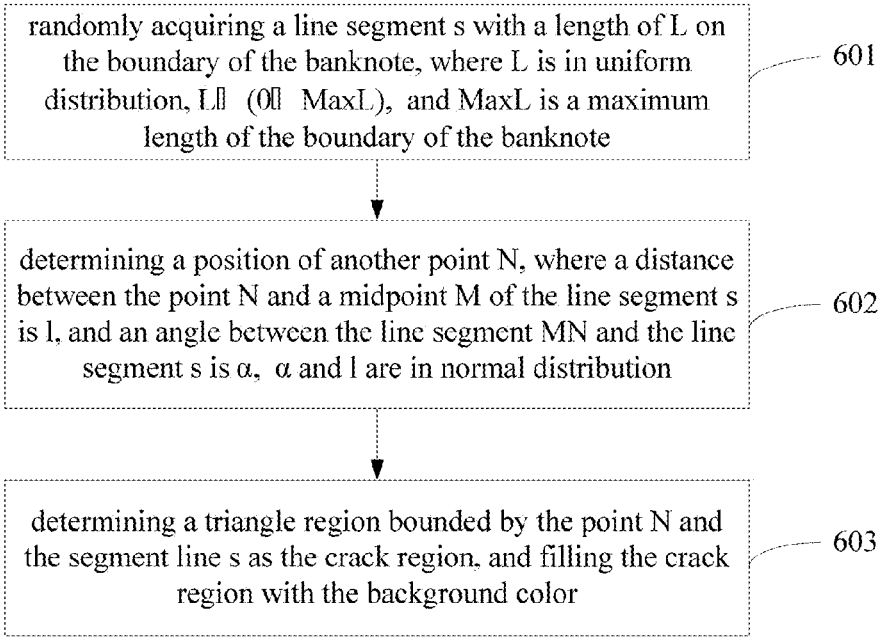
FIG. 13 is a flow chart of establishing a banknote crack degeneration model according to a preset rule.

FIG. 13 is a flow chart of establishing a banknote crack degeneration model according to a preset rule. The establishing a banknote crack degeneration model according to a preset rule includes following steps.

Step 601 includes: randomly acquiring a line segment s with a length of L on the boundary of the banknote, where L is in uniform distribution, $L \in (0, MaxL)$, and MaxL is a maximum length of the boundary of the banknote.

Step 602 includes: determining a position of another point N, wherein a distance between the point N and a midpoint M of the line segment s is 1, and an angle between the line segment MN and the line segment s is a, wherein $l \in (0, Maxl)$, the angle $\alpha \in (\pi/3, 2\pi/3)$, and $\alpha$ and l are in normal distribution.

Step 603 includes: determining a triangle region bounded by the point N and the segment line s as the crack region, and filling the crack region with the background color.

Figure 14:
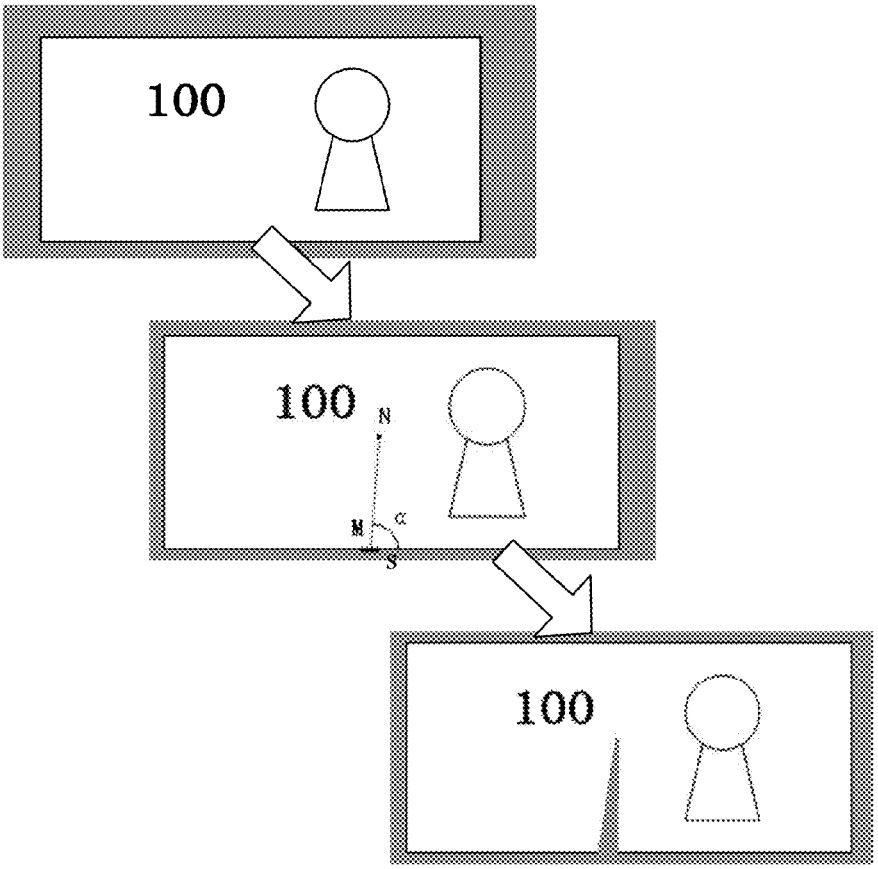
FIG. 14 is a schematic diagram showing steps of banknote image degeneration based on a crack noise model.

FIG. 14 is a schematic diagram showing steps of banknote image degeneration based on a crack noise model.

Figure 15:
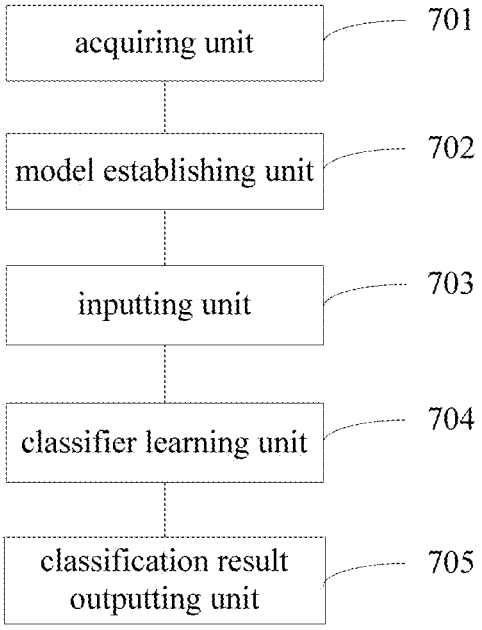
FIG. 15 is a schematic structural diagram of a system for recognizing and classifying banknotes disclosed according to an embodiment of the disclosure.

Based on the foregoing embodiments disclosed according to the disclosure, a system for recognizing and classifying banknotes is disclosed according to the disclosure. FIG. 15 is a schematic structural diagram of a system for recognizing and classifying banknotes according to the embodiment of the disclosure. The system for recognizing and classifying banknotes disclosed according to the disclosure includes following structures: an acquiring unit 701 configured to acquire sample information of brand new banknotes to be learned and banknote sample information to be recognized, a model establishing unit 702 configured to establish a banknote sample signal degeneration model according to a preset rule, an inputting unit 703 configured to input the sample information into the banknote sample signal degeneration model to acquire various banknote sample information corresponding to the brand new banknote to be learned, a classifier learning unit 704 configured to input the various banknote sample information to perform classifier learning, and output a banknote classification model, and a classification result outputting unit 705 configured to perform sample signal preprocessing and feature extraction on the sample information to be recognized, perform classification decision on the banknote to be recognized by using the classification model, and output a final classification result.

In conclusion, a method and for recognizing and classifying banknotes and a system thereof are disclosed according to the disclosure. The method includes: acquiring sample information of brand new banknotes to be learned and banknote sample information to be recognized; establishing, according to a preset rule, a banknote sample signal degeneration model; inputting the sample information into the banknote sample signal degeneration model to acquire various banknote sample information corresponding to the brand new banknote to be learned; inputting the various banknote sample information to perform classifier learning, and outputting a banknote classification model; performing sample signal preprocessing and feature extraction on the sample information to be recognized, performing classification decision on the banknote to be recognized by using the classification model, and outputting a final classification result. In the method, large amount of existing samples which are reliable and easily accessible are used to statistically establish a sample signal degeneration model which satisfies application requirement, to simulate the states of banknotes such as brand new condition, 80%-90% new condition, 70%-80% new condition, 0-70% new condition, contamination in varying degrees, incompletion in varying degrees, crack in varying degrees and folds in some regions, then classifier learning is performed, and classification recognition is performed on the sample to be recognized, thereby accurately acquiring a classification result, and decreasing cost and efficiency for developing banknote recognition product while ensuring improvement of classifier precision.

According to the description of the disclosed embodiments, the disclosure may be implemented or used by the person skilled in the art. Various modifications made to these embodiments are apparent for persons skilled in the art, and a normal principle defined in the disclosure may be implemented in other embodiments without departing from spirit or scope of the disclosure. Therefore the disclosure is not limited to the embodiments described in the disclosure but confirms to a widest scope in accordance with principles and novel features disclosed in the disclosure.

The invention claimed is:

1. A method for recognizing and classifying banknotes in a banknote processing device comprising:

acquiring, by a processor, sample information of brand new banknotes to be learned and banknote sample information to be recognized, wherein the brand new banknotes are banknotes with brightness in a predetermined degree;

establishing, by the processor according to a preset rule, a banknote sample signal degeneration model, wherein the banknote sample signal degeneration model comprises: a banknote condition degeneration model established based on linear change of image brightness, and a banknote image degeneration model established based on randomness of a statistic model, wherein the banknote image degeneration model comprises signal degeneration models for banknote contamination, banknote incompletion, banknote crack, and banknote fold or deflection, and the banknote condition degeneration model comprises degeneration models for banknotes in brand new condition, banknotes in 80%-90% new condition, banknotes in 70%-80% new condition, and banknotes in 0-70% new condition, wherein the establishing the banknote contamination degeneration model according to the preset rule comprises presetting that a banknote contamination region is circular and a stain is circular, and each banknote only have one contamination region; and determining, according to statistics analysis, that probability density curves for a position of the contamination region and a position of the stain in the contamination region are constants, i.e., the probability density curves are in uniform distribution $X \sim U(a,b)$, and a probability density curve for a size of the contamination region and probability density curves for size, density and gray value of the stain are in normal distribution $X \sim N(\mu, \sigma^2)$;

inputting, by the processor, the sample information into the banknote sample signal degeneration model to acquire various banknote sample information corresponding to the brand new banknotes to be learned, wherein the various banknote sample information corresponding to the brand new banknotes to be learned comprises sample information for banknotes with brightness in varying degrees;

inputting, by the processor, the various banknote sample information to perform classifier learning, and outputting a banknote classification model; and performing, by the processor, sample signal preprocessing and feature extraction on the sample information to be recognized, performing classification decision on the banknote to be recognized by using the classification model, and outputting a final classification result.

2. The method according to claim 1, wherein the establishing the banknote condition degeneration model according to the preset rule comprises:

analyzing a gray distribution $f(x)=ax+b$ of an image for a banknote of a specific denomination of a specific currency, and dividing, according to gray similarity, the banknote of the specific denomination of the specific currency into five regions;

selecting a set of samples in brand new condition, and performing statistics on average gray value G for each banknote in the set;

selecting a set of samples in one of the conditions, and performing statistics on average gray value g for respective regions of each sample;

matching the average gray values G to the average gray values g respectively;

combining every two of the formulas $f(x)=ax+b$ for the five regions to calculate a and b for each formula; and selecting a set of samples in brand new condition, and calculating average gray value for each region of all banknote images, where each average gray value corresponds to a mapping to the gray distribution $f(x)=ax+b$.

3. The method according to claim 1, wherein the establishing the banknote incompletion degeneration model according to the preset rule comprises:

determining, according to statistics analysis, a position, a size and a shape of an incompletion, wherein:

a probability density curve of the position of the incompletion is a constant;

a probability density curve of the size of the incompletion is in normal distribution; and the shape of the incompletion is polygon which is any one of trigon to octagon, convex polygon or concave polygon, and a probability density curve of the shape of the incompletion is a constant.

4. The method according to claim 1, wherein the establishing the banknote folding or deflection degeneration model according to the preset rule comprises:

dividing the banknote into two columns and two rows to form four uniform rectangular regions each having a long side and a short side which belong to edges of the banknote;

randomly selecting one of the regions, randomly selecting one point of the short side of the region, and randomly selecting another point of the long side of the region;

determining whether a distance between the two points, i.e., the distances x (a distance on the long side) and y (a distance on the short side) from the two points to the vertex, satisfy a constraint condition of $\sqrt{x^2+y^2}<k, x<m, y<n$; if the distance between the two points satisfies the constraint condition, proceeding to a next step; and if the distance between the points does not satisfy the constraint condition, returning to the previous step; and filing a deflection region, which has an edge being a straight line determined by the two points and has a point beyond the edge, with background color.

5. The method according to claim 1, wherein the establishing the banknote crack degeneration model according to the preset rule comprises:

randomly acquiring a line segment s with a length of L on the boundary of the banknote, wherein L is in uniform distribution, $L\epsilon(0,MaxL)$ , and MaxL is a maximum length of the boundary of the banknote;

determining a position of another point N, wherein a distance between the point N and a midpoint M of the line segment s is 1, and an angle between the line segment MN and the line segment s is, wherein $l\epsilon(0, Maxl)$ , the angle $\alpha\epsilon(\pi/3,2\pi/3)$ , and $\alpha$ and 1 are in normal distribution; and determining a triangle region bounded by the point N and the segment line s as the crack region, and filling the crack region with background color.

6. A system for recognizing and classifying banknotes in a banknote processing device comprising at least one processor and a memory having processor-executable instructions stored therein, and the instructions when executed by the at least one processor, configure the device to:

acquire sample information of brand new banknotes to be learned and banknote sample information to be recognized, wherein the brand new banknotes are banknotes with brightness in a predetermined degree;

establish a banknote sample signal degeneration model according to a preset rule, wherein the banknote sample signal degeneration model comprises: a banknote condition degeneration model established based on linear change of image brightness, and a banknote image degeneration model established based on randomness of a statistic model, wherein the banknote image degeneration model comprises signal degeneration models for banknote contamination, banknote incompletion, banknote crack, and banknote fold or deflection, and the banknote condition degeneration model comprises degeneration models for banknotes in brand new condition, banknotes in 80%-90% new condition, banknotes in 70%-80% new condition, and banknotes in 0-70% new condition;

preset that a banknote contamination region is circular and a stain is circular, and each banknote only have one contamination region;

determine, according to statistics analysis, that probability density curves for a position of the contamination region and a position of the stain in the contamination region are constants, i.e., the probability density curves are in uniform distribution $X\sim U(a,b)$, and a probability density curve for a size of the contamination region and probability density curves for size, density and gray value of the stain are in normal distribution $X\sim N(\mu,\sigma^2)$;

input the sample information into the banknote sample signal degeneration model to acquire various banknote sample information corresponding to the brand new banknote to be learned, wherein the various banknote sample information corresponding to the brand new banknotes to be learned comprises sample information for banknotes with brightness in varying degrees;

a classifier learning unit configured to input the various banknote sample information to perform classifier learning, and output a banknote classification model; and a classification result outputting unit configured to perform sample signal preprocessing and feature extraction on the sample information to be recognized, perform classification decision on the banknote to be recognized by using the classification model, and output a final classification result.

* * * * *